US008986084B2

(12) United States Patent
Starke et al.

(10) Patent No.: US 8,986,084 B2
(45) Date of Patent: Mar. 24, 2015

(54) DEVICE FOR RECEIVING COINS

(75) Inventors: Christian Starke, Paderborn (DE); Thorsten Neumann, Paderborn (DE); Axel Grimm, Steinheim (DE); Stig Goepel, Osten (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 13/416,035

(22) Filed: Mar. 9, 2012

(65) Prior Publication Data

US 2012/0231719 A1 Sep. 13, 2012

(30) Foreign Application Priority Data

Mar. 10, 2011 (DE) ..... 10 2011 005 381

(51) Int. Cl.
*G07D 1/00* (2006.01)
*G07D 9/00* (2006.01)

(52) U.S. Cl.
CPC ..... *G07D 9/008* (2013.01)
USPC ..... 453/55; 453/3; 194/200; 194/344; 194/347; 194/350

(58) Field of Classification Search
USPC ..... 453/55, 3, 18, 29; 198/530–534, 459.6; 194/200, 344, 347, 350; 222/161, 222/196–201
See application file for complete search history.

(56) References Cited

U.S. PATENT DOCUMENTS 2,012,881 A * 8/1935 Lee ..... 432/78
2,769,524 A 11/1956 Rogier et al.
3,531,872 A * 10/1970 Watson et al. ..... 34/315
3,777,769 A * 12/1973 Ueno ..... 453/32
4,986,408 A * 1/1991 Carter et al. ..... 198/368
5,767,455 A * 6/1998 Mosher ..... 177/64
6,053,807 A 4/2000 Metzger et al.
6,736,258 B2 * 5/2004 Noda et al. ..... 198/550.3
2004/0097182 A1 * 5/2004 Hill et al. ..... 453/3
2010/0015903 A1 * 1/2010 Nishida ..... 453/57

FOREIGN PATENT DOCUMENTS

DE 19709515 C1 10/1998
DE 19943562 A1 3/2001
DE 102005056191 A1 5/2007
EP 1418548 A2 5/2004
EP 2071527 A1 6/2009

OTHER PUBLICATIONS http://en.wikipedia.org/wiki/Pendulum, dated Jul. 6, 2014.*

* cited by examiner

*Primary Examiner* — Jeffrey Shapiro
(74) *Attorney, Agent, or Firm* — Patent Central LLC; Stephen A. Pendorf

(57) ABSTRACT

Device for receiving coins improved in such a way that large amounts of coins can be received as well as separated reliably and quickly and such that the adverse influence of foreign matters introduced along with the coins on the coin separating function and/or on the performance of the coin separating unit may be reduced. The device includes an aperture for charging coins, a unit for separating coins and a feed unit for feeding coins which is provided with a guide face giving support to the coins during the feeding process and which is an active type feeder having a feed module (5) that is operable with the aid of an actuator means to feed coins toward the coin separating unit and that is designed such that the coins are transported toward the coin separating unit along said guide face.

8 Claims, 2 Drawing Sheets

DEVICE FOR RECEIVING COINS

FIELD OF THE INVENTION

This present invention relates to a device for receiving coins with an aperture for charging coins, a unit for separating coins entered into the charge aperture and a means for feeding coins entered to the coin separating unit which is provided with a guide face giving support to the coins during the feeding process.

BACKGROUND OF THE INVENTION

A device of this species is for instance known from DE 10 2005 056 191 B4. This device comprises a coin separating unit with a sloping base plate, entraining elements assigned to said base plate to entrain and feed coins resting on the base plate and a flap disposed within said base plate. Coins present in a lower portion of the base plate are fed toward said flap by the entraining elements. The flap coacts with a closing mechanism adapted to synchronize the opening and closing of the flap with the movement of said entraining elements. Individual coins transported by the entraining elements can be passed through the flap and separated this way. The coin separating unit is of rotating and/or revolving type since the base plate is disk shaped and the entraining elements assigned to said base plate are rotatable around a pivot axis.

To feed coins to the lower portion of the base plate they are entered into the device via a charge aperture and along a guide face fed to a cover means that is spaced from the coin separating unit and that serves as a feed unit. Said guide face is designed and arranged in such a way that coins being entered are exclusively fed to said lower area of the base plate and stored there in unsorted condition.

Even though this prior-art device has been used with generally acceptable results it is yet affected by the drawback that its performance is hampered when large amounts of coins are entered. This is particularly due to an increase of coin weight in the lower portion of the base plate and to possible jams which inhibit that each and any individual coin can be fed from a stock of coins. Moreover, the coin separating unit might get damaged by foreign matters adhering to the coins and/or detrimentally affected in its functional performance.

It is an object of this present invention therefore to improve a device for receiving coins in such a way that large amounts of coins also can be received as well as separated reliably and quickly and that the adverse influence of foreign matters introduced along with the coins on the coin separating function and/or on the performance of the coin separating unit may be reduced.

SUMMARY OF THE INVENTION

To achieve this object the invention is characterized in that the feed unit is an active type feeder having a feed module that is operable with the aid of an actuator means to feed coins toward the coin separating unit which is designed such that the coins are transported toward the coin separating unit along said guide face.

The particular advantage of this invention resides in that due to provision of an active type coin feed module the amount of coins fed to the coin separating unit may be restricted and/or varied per unit time. Thus it may be ensured by appropriate adaption of the module's feed volume that a safe coin feed rate will not be exceeded. It is possible this way that a coin load that acts on the coin separating, unit and that is defined as being due to coins fed to the separating unit, but not yet separated, may be restricted to thereby inhibit jams. This means that the overall performance of the device is improved to the effect that a given amount of coins can be received and handled generally faster. A rugged design of the feed module is moreover ensured due to the fact that coins are transported along a guide face.

A preferred embodiment of this invention provides for the feed module of the feed unit to be of vibratory type. The guide face of said vibratory type feed module is induced to generate vibrations. It is an advantage that the transport of coins along such a vibratory line is particularly dependable and safe. The vibratory type guide face can be mechanically rugged and activated via the actuator means in such a way that a predetermined transport and/or coin feed rate will be achieved and damages to the feed module will be prevented.

According to a modification of the invention is the guide face provided with a plurality of recesses. These recesses are so dimensioned that coins backed up by said guide face cannot slip through any of the recesses. Provision of said recesses affords the advantage that the coins are cleaned on their way to the coin separating unit already. Foreign matters adhering to the coins can be discharged via the recesses such that the coins to be separated are substantially free of any such foreign substances and damages to the coin separating unit are reduced.

A further modification of this invention provides for the feed unit to comprise a transfer module which is assigned to the guide face and of such design that the feed rate of the feed unit is restricted by a blocking element that is rotatable relative to the guide face. This blocking element is arranged such a distance away from the guide face that individual coins and/or smaller amounts of coins fed along the guide face are allowed to pass beneath said blocking element unbraked while larger amounts of coins are in part retained thereby. The advantage afforded by said transfer module resides in that the coin feed flow to the coin separating unit can be reduced and/or restricted. The transfer module is hence taking care also that the coin load acting on the coin separating unit is reduced and/or limited and that jams are prevented. Restriction of the coin feed rate can be achieved in a particularly simple way due to the fact that the blocking element is provided somewhat like a swing door. Particularly in coaction with the vibratory type feed module is the coin feed rate well adjustable. This means that any jams that might occur during the feed of coins in the area of the coin transfer module are dependably prevented due said movable suspension of the blocking element.

A still further modification of the invention provides for the feed unit to have a detector module to detect the volume of coins filled into the coin separating unit. This detector unit coacts with the actuator means of the coin feeder drive in such an way that a given maximum coin load acting on the coin separating unit will not be exceeded during a coin separating process. It is an advantage afforded by said detector module that a particularly efficient performance of the coin separating unit will be achieved. The detector module may for instance comprise an optical sensor or a weight sensor to detect a coin load. Both the optical detection of the coin load and the determination of the coin weight can be done in a particularly rugged way.

Further advantages of this present invention are as disclosed in the subclaims.

BRIEF DESCRIPTION OF THE DRAWINGS

The invention will be described in closer detail hereafter with reference to the accompanying drawings wherein.

DETAILED DESCRIPTION OF THE INVENTION

Figure 1:
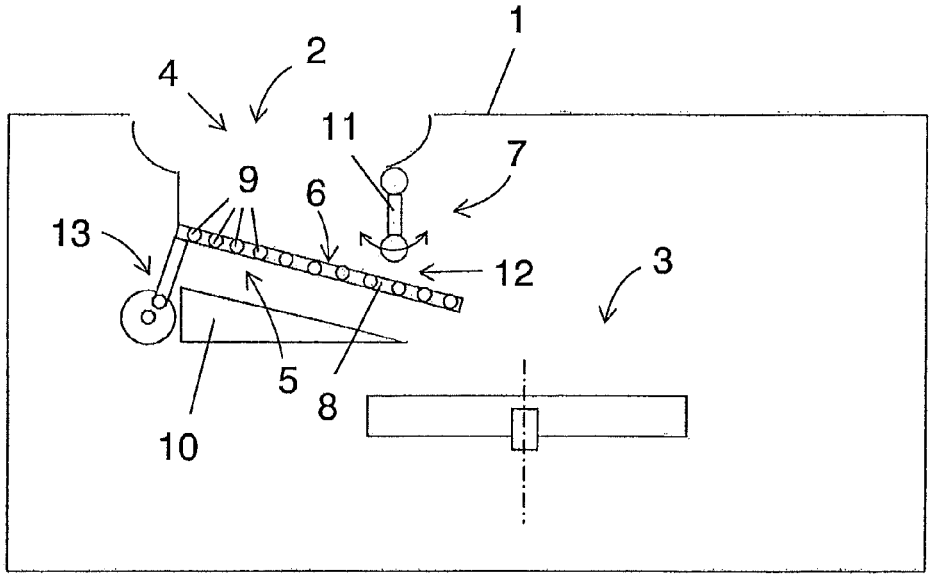
FIG. 1 shows a device for receiving coins with an aperture for charging coins, a unit for separating coins entered into the charge aperture and a feed unit for feeding coins entered to the coin separating unit.

A device for receiving coins of this present invention as shown in FIG. 1 substantially comprises a casing 1 with a charge aperture 2 for inserting coins, a coin separating unit 3 and a feed unit 4 to feed coins introduced via said charge aperture 2 to the coin separating unit 3. This device serves to receive coins from a self-service cash system for instance.

Figure 2:
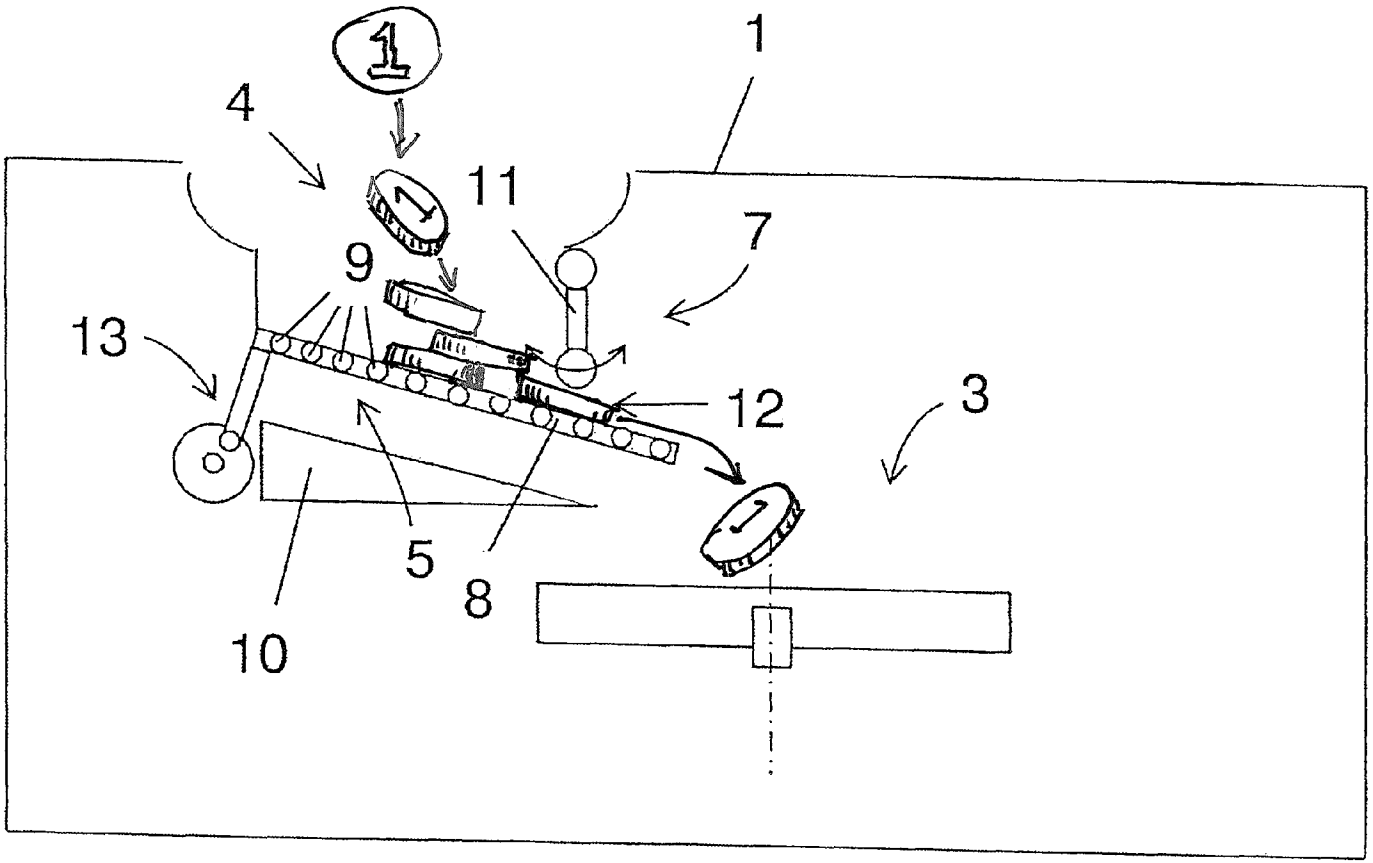
FIG. 2 shows coins flowing through the device.

For receiving coins, as shown in FIG. 2 a customer inserts the coins via the charge opening 2 unsorted. These unsorted coins are then fed to the coin separating unit 3 by means of the feed unit 4 and separated. Following coin separation there are normally performed a coin value recognition process and a check for genuineness of the coins. The coins can be finally stored in a not shown coin storage means either unsorted or sorted by species after their value has been determined. In particular may coins stored in sorted condition be dispensed as change money to other customers.

The feed unit 4 is arranged beneath the charge aperture 2 inside the casing 1. It substantially consists of a feed module 5 having a guide face 6 to back up the coins and a transfer module 7. Said guide face 6 is inclined toward the coin separating unit 3. The feed module 5 is of vibratory type provided with a supporting element 8 comprising said guide face 6. An eccentric 13 for instance may be part of a not shown actuator means to make the supporting element 8 vibrate. It is due to said generation of vibrations and the inclined arrangement of the guide face 6 that the coins entered via the charge aperture 2 are actively fed toward the coin separating unit 3 by the feed module 6.

The supporting element 6 has a number of recesses 9 which are dimensioned such that coins carried along the guide face 6 cannot get through them while foreign matters introduced with coins via the charge aperture 2, for instance impurities, are allowed to pass through said recesses 9 and are thus separated from the coins. Foreign matters are collected in a collecting bin 10 arranged on a side opposite the charge aperture 2.

The coin separating unit 3 is for instance of revolving type although it is possible for said unit 3 to be of different shape and design.

The transfer module 7 is spaced from the guide face 6 of the feed module 5 and comprises a blocking element 11 arranged on the casing 1 which is movable relative to said casing 1 and to said feed module. A passage 12 is provided between the blocking element 11 of the transfer module 7 and the guide face of the feed module 5. The blocking element 11 is disposed such a distance away from the guide face 6 that individual coins and/or small coin amounts fed along the guide face 6 can freely pass through said passage 12 while larger coin volumes liable to produce an impermissibly heavy load when fed to the coin separating unit 3 simultaneously are retained in part by the blocking element 11 with the result that the feed rate of the feed unit 5 is reduced and the coin load acting on the coin separating unit 3 is restricted. Said blocking element 11 may be arranged in the casing 1 such as to swing to two sides like a saloon door or garden gate does for instance. The blocking element 11 may in that case be kept in a rest position as represented by not shown spring means or solely by its weight.

It is due to coaction of feed module 5 and transfer module 6 that an amount of coins fed to the coin separating unit 3 may be influenced in different ways. On the one hand does the transfer module 7 restrict the feed rate of the feed unit 4 and the maximum coin load acting on the coin separating unit 3. Especially when large coin volumes are entered can the transfer module 7 increase the performance of the coin separating unit by dependably restricting the coin load and preventing the occurrence of mechanical jams that may be due to excessive coin loads. In addition, a sequential feed of coins is ensured by the vibratory type feed module 5 irrespective of what amount of coins may be involved. The coin feed rate can be varied via the vibration intensity of the supporting element 8 with certain limits at least. It is particularly when receiving small coin volumes that the coin load can be varied or restricted solely via the feed volume.

The invention claimed is:

1. A device for receiving coins with a charge aperture for charging coins, a unit for separating coins entered into the charge aperture, and a feed unit between the charge aperture and the unit for separating coins, the feed unit for feeding coins to the unit for separating coins, which feed unit is provided with a guide face (6) giving support to the coins during the feeding process, wherein the feed unit (4) is an active type feeder having a feed module (5) that is operable with the aid of an actuator means to feed coins toward the coin separating unit (3) and that is designed such that the coins are transported toward the coin separating unit (3) along said guide face, wherein the feed unit (4) has a transfer module (7) to restrict a feed rate of said feed unit (4) comprising a blocking element (11), wherein the blocking element (11) of said transfer module (7) is movable to swing from a rest position in two directions in relation to the feed module (5) and is arranged such a distance away from the guide face (6) of the feed module (5) as to define a passage of a size that can vary with the swinging of the blocking element (11) such that individual coins or small coin volumes can be moved through the passage (12) between blocking element (11) and guide face (6) freely while larger coin volumes are in part retained by said blocking element (11), wherein the guide face (6) has a plurality of recesses (9) which are so dimensioned that coins carried along the guide face (6) cannot slip through any of these recesses (9), and wherein the guide face (6) is inclined downwards toward the coin separating unit (3).

2. The device according to claim 1, wherein a collecting bin (10) is arranged on a side of the guide face (6) opposite to the charge aperture (2) to collect foreign matters dropped through said recesses (9).

3. The device according to any claim 1, wherein the actuator means coacting with the transfer module (5) of the feed unit (6) comprises a motor driven eccentric (13) mechanically linked to the feed unit so as to induce vibration in the guide face.

4. The device according to claim 1, wherein the swing of the blocking element (11) is biased towards a rest position by spring means or solely by weight.

5. A device for receiving coins with a charge aperture for charging coins, a unit for separating coins entered into the charge aperture, and a feed unit between the charge aperture and the unit for separating coins, the feed unit for feeding coins to the unit for separating coins, which feed unit is provided with a guide face giving support to the coins during the feeding process, wherein the feed unit (4) is an active type feeder having a feed module (5) that is operable with the aid of an actuator means to feed coins toward the coin separating unit (3) and that is designed such that the coins are transported toward the coin separating unit (3) along said guide face, wherein the feed unit (4) has a transfer module (7) to restrict a feed rate of said feed unit (4) comprising a blocking element (11), wherein the blocking element (11) of said transfer module (7) is movable to swing from a rest position in two directions in relation to the feed module (5) and is arranged such a distance away from the guide face (6) of the feed module (5) as to define a passage of a size that can vary with the swinging of the blocking element (11) such that individual coins or small coin volumes can be moved through the passage (12) between blocking element (11) and guide face (6) freely while larger coin volumes are in part retained by said blocking element (11), wherein the feed module (5) of the feed unit (4) is of vibratory type wherein the guide face (6) is induced to vibrate, wherein the guide face (6) has a plurality of recesses (9) which are so dimensioned that coins carried along said guide face (6) cannot slip through any of these recesses (9), and wherein the guide face (6) is inclined downwards toward the coin separating unit (3).

6. The device according to claim 5, wherein the swing of the blocking element (11) is biased towards a rest position by spring means or solely by weight.

7. A device for receiving coins with a charge aperture for charging coins, a unit for separating coins entered into the charge aperture, and a feed unit between the charge aperture and the unit for separating coins, the feed unit for feeding coins to the unit for separating coins, which feed unit is provided with a guide face (6) giving support to the coins during the feeding process, wherein the feed unit (4) is an active type feeder having a feed module (5) that is operable with the aid of an actuator means to feed coins toward the coin separating unit (3) and that is designed such that the coins are transported toward the coin separating unit (3) along said guide face, and wherein the feed unit (4) has a transfer module (7) to restrict a feed rate of said feed unit (4) comprising a blocking element (11), wherein the blocking element (11) of said transfer module (7) is movable to swing from a rest position in two directions in relation to the feed module (5) and is arranged such a distance away from the guide face (6) of the feed module (5) as to define a passage of a size that can vary with the swinging of the blocking element (11) such that individual coins or small coin volumes can be moved through the passage (12) between blocking element (11) and guide face (6) freely while larger coin volumes are in part retained by said blocking element (11), wherein the feed unit (4) is provided with a detector module to detect a coin load acting on the coin separating unit (3) which load is due to coins fed to, but not separated by, said unit (3), which detector module coacts with the actuator means of the active type feed module (5) such that a feed rate will be varied dependent on said detected prevailing coin load, wherein the guide face (6) has a plurality of recesses (9) which are so dimensioned that coins carried along the guide face (6) cannot slip through any of these recesses (9), and wherein the guide face (6) is inclined downwards toward the coin separating unit (3).

8. The device according to claim 7, wherein the swing of the blocking element (11) is biased towards a rest position by spring means or solely by weight.

* * * * *